US008635798B2

(12) United States Patent
Mulfinger

(10) Patent No.: US 8,635,798 B2
(45) Date of Patent: Jan. 28, 2014

(54) COMMUNICATION CONNECTOR SYSTEM FOR A WEAPON

(75) Inventor: Robert Neil Mulfinger, York Haven, PA (US)

(73) Assignee: Tyco Electronics Corporation, Berwyn, PA (US)

( * ) Notice: Subject to any disclaimer, the term of this patent is extended or adjusted under 35 U.S.C. 154(b) by 335 days.

(21) Appl. No.: 13/215,649

(22) Filed: Aug. 23, 2011

(65) Prior Publication Data

US 2013/0047482 A1 Feb. 28, 2013

(51) Int. Cl.
*F41A 19/00* (2006.01)

(52) U.S. Cl.
USPC ..... 42/84; 42/90

(58) Field of Classification Search
USPC ..... 42/84, 90, 71.01; 439/31, 122
See application file for complete search history.

(56) References Cited

U.S. PATENT DOCUMENTS

| | | | | |
|---|---|---|---|---|
| 3,508,188 | A | 4/1970 | Buck | |
| 4,426,910 | A | 1/1984 | Speer | |
| 5,179,235 | A | 1/1993 | Toole | |
| 5,434,091 | A | 7/1995 | Hill et al. | |
| 5,557,872 | A | 9/1996 | Langner | |
| 5,597,317 | A | 1/1997 | Hansell, III et al. | |
| 5,704,153 | A | 1/1998 | Kaminski et al. | |
| 5,706,600 | A | 1/1998 | Toole et al. | |
| 5,924,879 | A | 7/1999 | Kameyama | |
| 6,231,358 | B1 | 5/2001 | Kerr, Jr. et al. | |
| 6,434,875 | B1 | 8/2002 | Constant et al. | |
| 6,671,991 | B1 | 1/2004 | Danielson | |
| 7,128,592 | B2 | 10/2006 | Li | |
| 7,260,910 | B2 | 8/2007 | Danielson | |
| 7,338,288 | B1 * | 3/2008 | Kung et al. | 439/31 |
| 7,627,975 | B1 | 12/2009 | Hines | |

(Continued)

FOREIGN PATENT DOCUMENTS

| | | | |
|---|---|---|---|
| GB | 2 264 201 | A | 8/1993 |
| WO | 9429664 | | 12/1994 |
| WO | 2010053436 | A1 | 5/2010 |

OTHER PUBLICATIONS

International Search Report, International Application No. PCT/US2012/050852, International Filing Date, Aug. 15, 2012.

(Continued)

*Primary Examiner* — J. Woodrow Eldred

(57) ABSTRACT

A communication connector system for a weapon having an upper receiver at an upper part of the weapon with electronics associated with the upper receiver and a base at a lower part of the weapon with a lower receiver and a hand grip and that houses electronics and with the upper receiver rotatably coupled to the lower receiver and movable between a closed position and an open position includes an upper connector assembly configured to be coupled to the upper receiver. The upper connector assembly has an upper connector being configured to be communicatively connected to the electronics in the upper receiver. The upper connector has a mating interface. A lower connector assembly has a lower connector that is configured to be communicatively connected to the electronics in the base of the weapon. The lower connector is configured to be mounted to the hand grip. The lower connector has a mating interface configured to be mated with the mating interface of the upper connector when the upper receiver is in the closed position. The mating interfaces are physically separable from one another so the upper receiver is able to move to the open position.

20 Claims, 4 Drawing Sheets

(56) References Cited

U.S. PATENT DOCUMENTS

| | | | | |
|---|---|---|---|---|
| 7,743,547 | B2 | 6/2010 | Houde-Walter | |
| 7,818,910 | B2 * | 10/2010 | Young | 42/71.01 |
| 2006/0148301 | A1 | 7/2006 | Kim | |
| 2010/0083553 | A1 | 4/2010 | Montgomery | |
| 2010/0192443 | A1 | 8/2010 | Cabahug et al. | |
| 2010/0192448 | A1 | 8/2010 | Darian | |
| 2012/0144714 | A1 * | 6/2012 | Cabahug et al. | 42/73 |
| 2012/0192476 | A1 * | 8/2012 | Compton et al. | 42/84 |
| 2013/0185978 | A1 * | 7/2013 | Dodd et al. | 42/84 |

OTHER PUBLICATIONS

Annex to European Search Report, Mail Date, Mar. 14, 2013, EP 13 15 3303, Application No. 13153303.6-1801.

* cited by examiner

COMMUNICATION CONNECTOR SYSTEM FOR A WEAPON

BACKGROUND OF THE INVENTION

The subject matter herein relates generally to communication connector systems for weapons.

Weapons, such as AR-15s, M4's, M-16's, and others, include a rail having electronics mounted to or within the upper rail. The upper rail may include a laser, night vision scope, camera or other type of electronic that needs power. The electronics may also send or receive data. The weapons typically include electronics, including batteries, in the lower part of the weapon, such as in the butt stock, hand grip, lower receiver, which are communicatively connected to the electronics in the upper rail.

Connecting the electronics in the lower part of the weapon with the electronics in the upper rail has heretofore proven difficult. Some systems use wires along the outside of the gun that interconnect the electronics in the lower part of the weapon with the electronics in the upper rail. The wires tend to catch or snag or are exposed to be easily damaged, which is problematic. Other systems route wires internally, however the upper and lower receivers need to be completely redesigned, and thus are not compatible with existing parts. Additionally, the weapons are often disassembled, such as for cleaning, and having the internal wiring makes disassembly difficult.

A need remains for a communication connector system for a weapon that easily interconnects components in the rail with components in the lower part of the weapon. A need remains for a robust connector system for a weapon. A need remains for communication connector system for a weapon that allows the weapon to be readily disassembled and easily reassembled.

BRIEF DESCRIPTION OF THE INVENTION

In one embodiment, a communication connector system is provided for a weapon. The weapon has an upper receiver at an upper part of the weapon with electronics associated with the upper receiver. The weapon has a base at a lower part of the weapon. The base has a lower receiver and a hand grip and optionally a butt stock. The base houses electronics. The upper receiver is rotatably coupled to the lower receiver and movable between a closed position and an open position. The communication connector system has an upper connector assembly configured to be coupled to the upper receiver. The upper connector assembly has an upper connector that is configured to be communicatively connected to the electronics in the upper receiver. The upper connector has a mating interface. The communication connector system also includes a lower connector assembly having a lower connector that is configured to be communicatively connected to the electronics in the base of the weapon. The lower connector is configured to be mounted to the hand grip. The lower connector has a mating interface that is configured to be mated with the mating interface of the upper connector when the upper receiver is in the closed position. The mating interfaces are configured to be physically separable from one another so the upper receiver is movable to the open position.

In another embodiment, a communication connector system is provided for a weapon. The weapon has an upper receiver at an upper part of the weapon with electronics associated with the upper receiver. The weapon has a base at a lower part of the weapon. The base has a lower receiver and a hand grip and optionally a butt stock. The base houses electronics. The upper receiver is rotatably coupled to the lower receiver and movable between a closed position and an open position. The communication connector system has an upper connector assembly configured to be coupled to the upper receiver. The upper connector assembly has an upper connector that is configured to be communicatively connected to the electronics in the upper receiver. The upper connector has a mating interface. The communication connector system also includes a lower connector assembly having a lower connector and a tether connector that are both configured to be communicatively connected to the electronics in the base of the weapon. The lower connector and the tether connector are both configured to be mounted to the hand grip. The lower connector has a mating interface configured to be mated with the mating interface of the upper connector when the upper receiver is in the closed position. The mating interfaces are physically separable from one another so the upper receiver is able to move to the open position. The tether connector is externally accessible external to the weapon and configured for connection with an external connector.

In a further embodiment, a weapon is provided having a base having a lower receiver that has a forward attachment point and a rearward attachment point. The base has a hand grip extending from the lower receiver proximate to the rearward attachment point. The base houses electronics therein. An upper receiver is removably attachable to the lower receiver at the forward attachment point and the rearward attachment point. The upper receiver has a forward attachment point and a rearward attachment point. The upper receiver has electronics. Front and rear takedown pins connect the upper and lower receivers at the forward and rearward attachment points, respectively. The upper receiver is rotatably coupled to the lower receiver at the forward attachment points when the rear takedown pin is removed from the rearward attachment points. The upper receiver is rotatable about the front takedown pin between an open position and a closed position. The rear attachment points are aligned and configured to receive the rear takedown pin in the closed position. The rear attachment points are positioned apart from one another in the open position. The weapon also includes a communication connector system that communicatively connects the electronics of the base of the weapon with the electronics of the upper receiver. The communication connector system includes an upper connector assembly coupled to the upper receiver. The upper connector assembly has an upper connector that is communicatively connected to the electronics in the upper receiver. The upper connector has a mating interface. The communication connector system also includes a lower connector assembly having a lower connector that is communicatively connected to the electronics in the base of the weapon. The lower connector is mounted to the hand grip. The lower connector has a mating interface configured to be mated with the mating interface of the upper connector when the upper receiver is in the closed position. The mating interfaces are physically separable from one another so the upper receiver is able to be rotated to the open position.

DETAILED DESCRIPTION OF THE INVENTION

Figure 1:
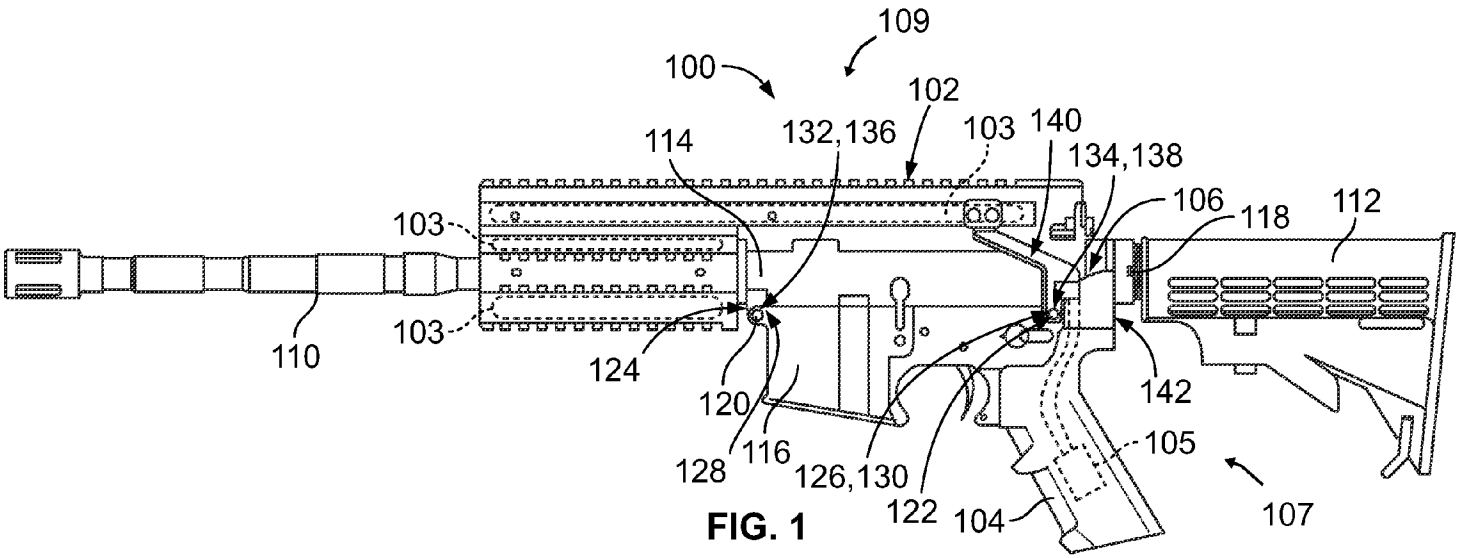
FIG. 1 is a side view of a weapon formed in accordance with an exemplary embodiment.
Figure 2:
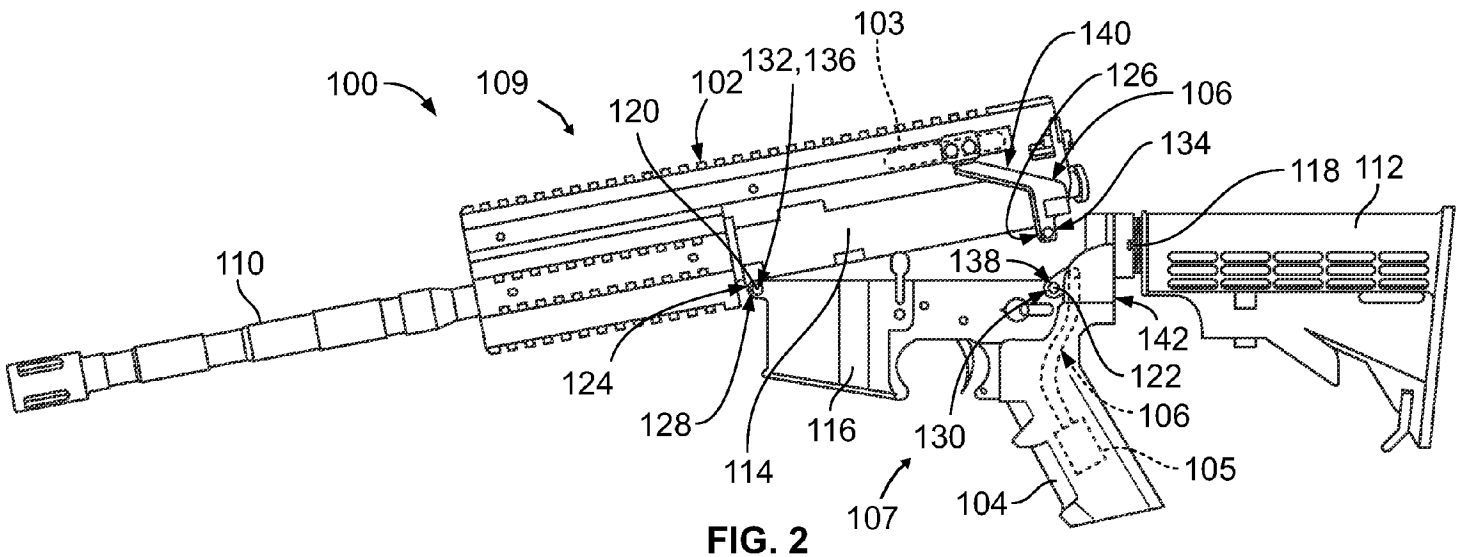
FIG. 2 is a side view of the weapon shown in FIG. 1 in an open state.

FIG. 1 is a side view of a weapon 100 formed in accordance with an exemplary embodiment and shown in a closed state. FIG. 2 is a side view of the weapon 100 in an open state. In the illustrated embodiment, the weapon 100 is an AR-15 style weapon, however other types of weapons may be used in alternative embodiments.

In an exemplary embodiment, the weapon 100 is of a type that includes a rail 102 having electronics 103 therein and a base 107 having electronics 105 therein. The base 107 includes a hand grip 104, a lower receiver 116 and a butt stock 112. The electronics 105 may be housed in any of the hand grip 104, the lower receiver 116 and/or the butt stock 112. The base may include other components of the weapon 100. The weapon 100 includes a communication connector system 106 that communicatively connects the electronics 105 of the base 107 with the electronics 103 associated with the rail 102. The electronics may be electrically connected, optically connected, inductively connected or connected by other means that facilitate communicating data and/or power therebetween. The communication connector system 106 transmits power and/or data between the rail 102 and the base 107. The communication connector system 106 includes connectors that are easily and repeatedly mated and unmated as the weapon 100 is moved between the closed state (shown in FIG. 1) and the open state (shown in FIG. 2).

In an exemplary embodiment, the communication connector system 106 also includes an external connector for interfacing with an external connector, such as an electrical connector and/or fiber optic connector provided at an end of cable extending from the user of the weapon 100. Data and/or power may be transmitted to and/or from the user and the weapon 100 via the external connector. The communication connector system 106 connectorizes the interface between the base 107 and the rail 102.

The weapon 100 includes an upper part 109 that is coupled to the lower part or base 107. The upper part 109 includes a barrel 110, an upper receiver 114 and the rail 102. The upper part 109 may include other components. The barrel 110 is provided at one end of the weapon 100 and the stock 112 is provided at the opposite end of the weapon 100. The weapon 100 includes the upper receiver 114 and the lower receiver 116 that are removably coupled to one another. The lower receiver 116 includes a buffer tube 118 extending rearward therefrom. The stock 112 is coupled to the buffer tube 118. The hand grip 104 is connected to or part of the lower receiver 116. The rail 102 is connected to or part of the upper receiver 114. The barrel 110 is held by the upper receiver 114. The stock 112 is held by the lower receiver 116.

The upper receiver 114 is coupled to the lower receiver 116 using a front takedown pin 120 and a rear takedown pin 122. The takedown pins 120, 122 may be removable from the weapon 100 to disassemble the weapon 100, such as for repair, replacement or cleaning of the various components of the weapon 100. Optionally, rather than removing the takedown pins 120 and/or 122 from the weapon 100, the takedown pins 120, 122 may remain attached to the upper receiver 114 and/or the lower receiver 116 while being unmated from the other of the upper receiver 114 or the lower receiver 116. When both takedown pins 120, 122 are removed (or released), the upper receiver 114 may be completely separated from the lower receiver 116. Typically, during use of the weapon 100, only the rear takedown pin 122 is removed allowing the upper receiver 114 to be rotatably coupled to the lower receiver 116 at the front takedown pin 120. The upper receiver 114 is movable between a closed position (shown in FIG. 1) and the open position (shown in FIG. 2) when the rear takedown pin 122 is removed. In the open position, internal components of the weapon 100 may be accessed, such as to remove a cartridge, casing or projectile jammed in the weapon 100 or for cleaning the barrel 110. To accommodate the opening and the closing of the upper receiver 114, the communication connector system 106 includes a separable interface that is readily and easily mated and unmated.

In an exemplary embodiment, the upper receiver 114 includes a front attachment point 124 and a rear attachment point 126. The lower receiver 116 includes a front attachment 128 and a rear attachment point 130. The upper receiver 114 is attached to the lower receiver 116 at the front and rear attachment points 124-130. The front attachment points 124, 128 are attached to one another using the front takedown pin 120. The rear attachment points 16, 130 are attached to one another using the rear takedown pin 122.

In an exemplary embodiment, the upper receiver 114 includes a front takedown pin opening 132 at the front attachment point 124. The upper receiver 114 includes and a rear takedown pin opening 134 at the rear attachment point 126. The lower receiver 116 includes a front takedown pin opening 136 at the front attachment point 128. The lower receiver 116 includes a rear takedown pin opening 138 at the rear attachment point 130. The front takedown pin openings 132, 136 are aligned with one another, and the front takedown pin 120 is inserted into the front takedown pin openings 132, 136 to couple the upper receiver 114 to the lower receiver 116 at the front attachment points 124, 128. The rear takedown pin openings 134, 138 are aligned with one another when the upper receiver 114 is in the closed position to receive the rear takedown pin 122 therethrough. In the open position (FIG. 2), the front takedown pin openings 132, 136 are not aligned with one another, but rather are spaced apart from one another.

The electronics 105 in the hand grip 104 may include various different types of components, such as batteries, circuit boards, flex circuits, switches, connectors and the like. The electronics 105 may be associated with external switches or buttons on the base 107, such as on the hand grip 104, used for activating various features of the weapon 100, such as a laser, a night vision scope, a camera, or other devices or systems associated with the weapon 100.

The electronics 103 associated with the rail 102 may include various different types of components, such as circuit boards, flex circuits, lasers, night vision scopes, cameras or other types of components or devices associated with the weapon 100. The communication connector system 106 is used to interconnect the electronics 105 in the base 107 with the electronics 103 associated with the rail 102. The communication connector system 106 includes separable connectors provided at the interface between the upper receiver 114 and the lower receiver 116. The separable connectors of the communication connector system 106 are automatically mated when the upper receiver 114 is moved from the open to the closed position, and are automatically unmated when the upper receiver 114 is moved from the closed position to the open position. In other embodiments, the separable connectors of the communication connector system 106 are mated and unmated while the weapon 100 is in the closed position.

The communication connector system 106 includes an upper connector assembly 140 associated with the upper receiver 114 and a lower connector assembly 142 associated with the lower receiver 116. The upper connector assembly 140 is movable with the upper receiver 114. The lower connector assembly 142 is fixed to the lower receiver 116. The upper connector assembly 140 is matable with, and unmatable from, the lower connector assembly 142 as the upper receiver 114 moves between the open and closed states. The rear takedown pin 122 secures the upper connector assembly 140 in a mated state with the lower connector assembly 142 when securing the upper receiver 114 to the lower receiver 116.

Figure 4:
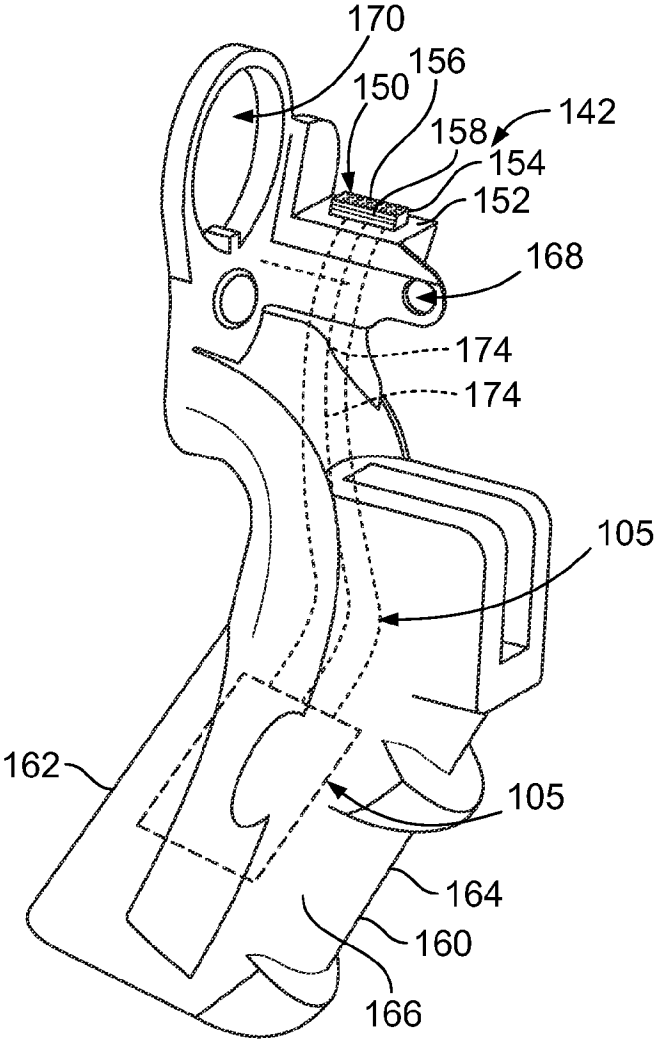
FIG. 4 is a side perspective view of the hand grip and the lower connector assembly shown in FIG. 3.
Figure 3:
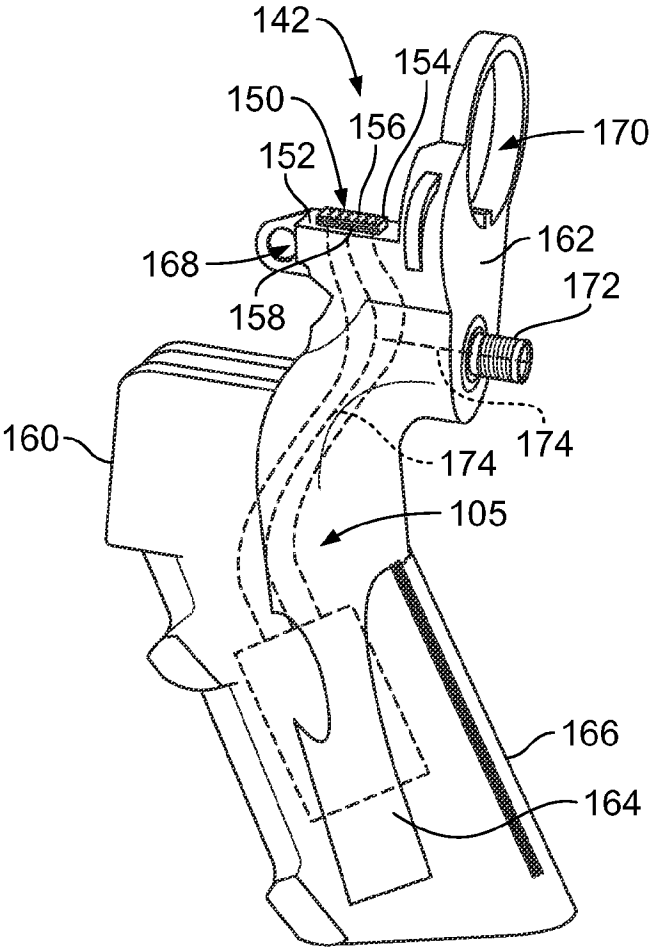
FIG. 3 is a side perspective view of a hand grip and a lower connector assembly of the weapon shown in FIGS. 1 and 2.

FIGS. 3 and 4 are side perspective views of the hand grip 104 and the lower connector assembly 142 formed in accordance with an exemplary embodiment. The lower connector assembly 142 is fixedly coupled to the hand grip 104. The electronics 105 are housed within the hand grip 104, however it is realized that the electronics 105 may be housed in other parts of the base 107 (shown in FIG. 1) in addition to or in the alternative to the hand grip 104 in alternative embodiments.

The lower connector assembly 142 includes a lower connector 150 coupled to the hand grip 104. In an exemplary embodiment, the lower connector 150 is exposed along an upper surface 152 of the hand grip 104. The lower connector 150 includes a connector housing 154 holding a plurality of contacts 156. In the illustrated embodiment, the contacts 156 are contact pads exposed along an upper surface 152 of the connector housing 154. The connector housing 154 includes a seal 158, such as a gasket, that extends around the connector housing 154. Optionally, the connector housing 154 may extend upward from the upper surface 152. In other embodiments, the connector housing 154 may be partially or entirely housed within the hand grip 104 such that the contacts 156 are exposed at, and substantially coplanar with, the upper surface 152. In other alternative embodiments, the contacts 156 may be recessed below the upper surface 152.

The hand grip 104 includes a front 160 and a rear 162. The hand grip 104 includes sides 164, 166 extending between the front and rear 160, 162. The upper surface 152 extends between the sides 164, 166 and/or the front and rear 160, 162. Optionally, the upper surface 152 may be at a top of the hand grip 104. The upper surface 152 may include all upward facing surfaces of the hand grip 104.

The hand grip 104 includes a takedown pin opening 168 extending therethrough. The takedown pin opening 168 is configured to be positioned adjacent, and aligned with, the rear takedown pin opening 138 (shown in FIGS. 1 and 2) of the lower receiver 116 (shown in FIGS. 1 and 2). The takedown pin opening 168 is configured to receive the rear takedown pin 122 (shown in FIGS. 1 and 2). Having the rear takedown pin 122 extend through the takedown pin opening 168 ensures that the hand grip 104 is aligned with the lower receiver 116 and the upper receiver 114 (shown in FIGS. 1 and 2) when the upper receiver 114 is in the closed position, thereby aligning the lower connector 150 with the upper connector assembly 140 (shown in FIGS. 1 and 2).

The hand grip 104 includes a buffer tube opening 170 extending therethrough. The buffer tube opening 170 is positioned at the rear 162. The buffer tube opening 170 is configured to receive the buffer tub 118 (shown in FIGS. 1 and 2). Having the buffer tube 118 extending through the hand grip 104 aligns the hand grip 104 with respect to the lower receiver 116. Having the buffer tube 118 extend through the buffer tube opening 170 creates an attachment point for the hand grip 104 with respect to the lower receiver 116. Having the buffer tube 118 extend through the buffer tube opening 170 rigidly fixes the upper portion of the hand grip 104 with respect to the other parts of the weapon 100 (shown in FIG. 1).

The lower connector assembly 142 includes a tether connector 172. The tether connector 172 is communicatively connected to the electronics 105 in the hand grip 104. The tether connector 172 is mounted to the rear 162 of the hand grip 104. The tether connector 172 may be positioned in other locations of the hand grip 104 or on other parts of the base 107 in alternative embodiments. The tether connector 172 is externally accessible exterior of the hand grip 104 and is configured for connection to an external connector, such as a connector terminated to an end of a cable extending from a user. Data and/or power may be transmitted to and/or from the user via the external connector and the tether connector 172.

In an exemplary embodiment, the tether connector 172 is communicatively connected to the lower connector 150. Optionally, the tether connector 172 and the lower connector 150 may be part of a single connector mounted to the hand grip 104. Alternatively, the tether connector 172 and the lower connector 150 may be separate connectors that are separately mounted to the hand grip 104 and communicatively connected to one another via electrical conductors, fiber optics and the like extending through the hand grip 104.

The tether connector 172 is communicatively connected to the electronics 105 within the hand grip 104. For example, communication conductors 174 may extend between the tether connector 172 and other components within the hand grip 104. The communication conductors may be wires or fibers routed through the hand grip 104. Alternatively, the communication conductors 174 may be part of a flex circuit routed within the hand grip 104. The communication conductors 174 are internal to the hand grip 104. The communication conductors 174 are also connected to the lower connector 150. The communication conductors 174 communicatively connect the lower connector 150 with the other components defining the electronics 105.

Optionally, a cap may be connected to the tether connector 172 when the external connectors not connected thereto, thereby protecting the tether connector 172. The tether connector 172 may include external threads for threadably connecting the external connector to the tether connector 172. The external connector may be secured to the tether connector 172 and/or the hand grip 104 using alternative fastening means in alternative embodiments.

Figure 5:
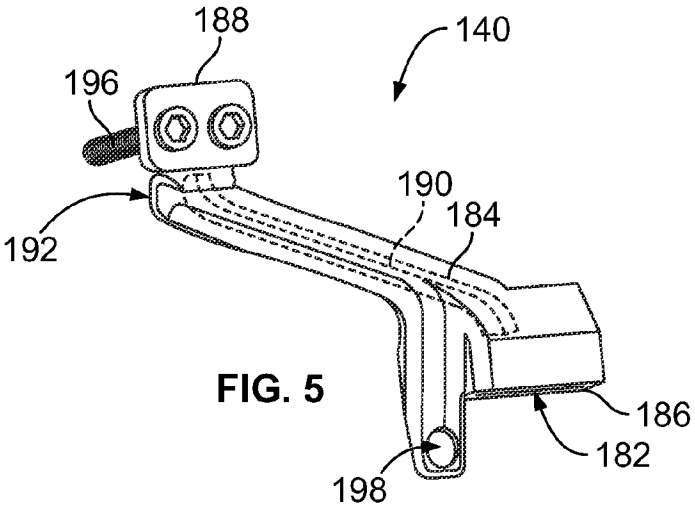
FIG. 5 is a side perspective view of an upper connector assembly of the weapon shown in FIGS. 1 and 2.
Figure 6:
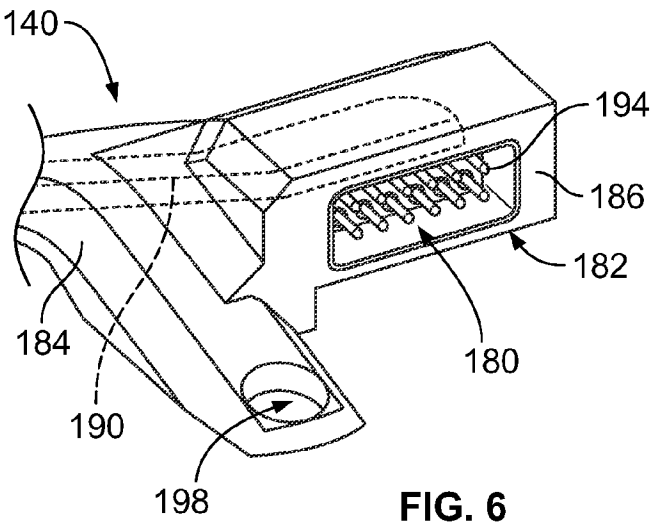
FIG. 6 is a bottom perspective view of a portion of the upper connector assembly shown in FIG. 5.

FIG. 5 is a side perspective view of the upper connector assembly 140 formed in accordance with an exemplary embodiment. FIG. 6 is a bottom perspective view of a portion of the upper connector assembly 140. The upper connector assembly 140 includes an upper connector 180 configured to be mated with the lower connector 150. The upper connector 180 includes a mating interface 182 that is configured to be mated with the lower connector 150. The upper connector assembly 140 includes a shroud 184 that holds the upper connector 180. The shroud 184 extends between a first end 186 and a second end 188. The upper connector 180 is provided at the first end 186. The first end 186 is downward facing such that the upper connector 180 is exposed along the bottom of the shroud 184.

Communication conductors 190 extend between the first and second ends 186, 188. The communication conductors 190 are communicatively connected to the upper conductor 180. The communication conductors 190 may be electrically, optically, inductively or otherwise connected to the various components of the communication connector system 106. The communication conductors 190 are configured to be communicatively connected to the electronics 103 (shown in FIGS. 1 and 2) associated with the rail 102 (shown in FIGS. 1 and 2) at the second end 188. Optionally, the communication conductors 190 may be individual wires or fibers routed within the shroud 184 between the upper connector 180 and a rail interface 192 proximate to the second end 188. Alternatively, the communication conductors 190 may be part of a flex circuit routed between the upper connector 180 and the rail interface 192. The upper connector 180 may define a socket that receives the lower connector 150. The seal 158 (shown in FIGS. 3 and 4) may engage the upper connector 150 to provide a seal between the upper connector 180 and the lower connector 150.

The upper connector 180 includes a plurality of contacts 194 that are configured to be communicatively connected to the contacts 156 (shown in FIGS. 3 and 4) of the lower connector. In the illustrated embodiment, the contacts 194 are pogo pins, however other types of contacts are possible in alternative embodiments, such as spring fingers, contact pads, and the like. The contacts 194 define a separable mating interface for the upper connector 180. The contacts 194 may be readily and easily mated to, and unmated from, the contacts 156 as the upper receiver 114 (shown in FIGS. 1 and 2) is moved between the open and closed positions.

In an exemplary embodiment, the shroud 184 is a rigid body shaped to be mounted directly to an outer surface of the upper receiver 114. The shroud 184 may be an after market addition for the weapon 100. Alternatively, the shroud 184 may be housed internally with respect to the upper receive 114. The shroud 184 may be manufactured from a rigid material, such as a metal material or a synthetic material. Fasteners 196 are used to secure the shroud 184 to the upper receiver 114. When the shroud 184 is secured to the upper receiver 114, the communication conductors 190 are communicatively connected to the electronics 103.

The shroud 184 includes a takedown pin opening 198 extending therethrough. The takedown pin opening 198 is configured to be aligned with the rear takedown pin opening 134 (shown in FIGS. 1 and 2) of the upper receiver 114 when the shroud 184 is connected to the upper receiver 114. The takedown pin opening 198 is configured to receive the rear takedown pin 122 when the weapon 100 is assembled. Having the takedown pin opening 198 receive the rear takedown pin 122 assures that the shroud 184 is properly aligned with respect to the upper receiver 114, the lower receiver 116, and therefore the lower connector 150. Having the rear takedown pin 122 extending through the takedown pin opening 198 ensures that the shroud 184 does not move with respect to the upper receiver 114 and/or the lower connector 150 when the upper receiver 114 is in the closed position, thereby ensuring that the upper connector 180 is communicatively connected to the lower connector 150.

Figure 7:
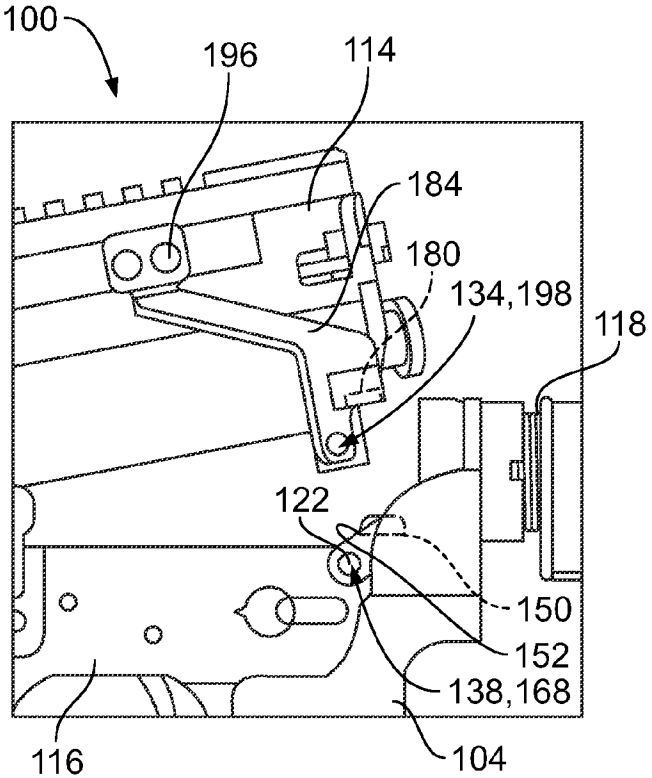
FIG. 7 illustrates a portion of the weapon showing an upper receiver thereof in an open position.

FIG. 7 illustrates a portion of the weapon 100 showing the upper receiver 114 in an open position. The upper receiver 114 is pivoted towards the lower receiver 116, such as in the direction of arrow A, as the upper receiver 114 is moved to the closed position. The hand grip 104 is fixed in position with respect to the lower receiver 116. The hand grip 104 is connected to the buffer tube 118, which extends through the buffer tube opening 170 of the hand grip 104. The takedown pin opening 168 of the hand grip 104 is aligned with the rear takedown pin opening 138 of the lower receiver 116.

The shroud 184 is coupled to the outer surface of the upper receiver 114 using the fasteners 196. The takedown pin opening 198 of the shroud 184 is aligned with the rear takedown pin opening 134 of the upper receiver 114. The upper connector 180 is provided at the interface between the upper receiver 114 and the lower connector 150 is provided at the interface of the hand grip 104 and/or lower receiver 116.

As the upper receiver 114 is moved to the closed position, the upper connector 180 is moved into engagement with the lower connector 150. The contacts 194 (shown in FIG. 6) are configured to engage the contacts 156 (shown in FIGS. 3 and 4) of the lower connector 150. A separable interface is defined between the contacts 194 and the contacts 156. The contacts 194 automatically engage the contacts 156 when the upper receiver 114 is rotated to the closed position. For example, as the upper receiver 114 is moved to the closed position, the lower connector 150 is received in the socket defined by the upper connector 180. No separate action is required by the user. For example, the user does not need to separately plug the lower connector 150 into the upper connector 180. No guidance is required by the user for guiding the lower connector 150 into the upper connector 180 as the upper receiver 114 is moved to the closed position. Having the upper connector 180 fixed within the shroud 184, which is fixed in position on the upper receiver 114 and having the lower connector 150 fixed in position along the upper surface 152 of the hand grip 104 ensures that the upper connector 180 is aligned with the lower connector 150 so that the upper connector 180 may be automatically mated with the lower connector 150 as the upper receiver 114 is moved to the closed position.

In the closed position, the takedown pin openings 198, 168, 138, 134 are all aligned with one another to receive the rear takedown pin 122. When the rear takedown pin 122 is positioned within the takedown pin openings 134, 138, 168, 198 the upper connector 180 is locked in a mated position with the lower connector 150. The upper connector 180 cannot be unmated from the lower connector 150 without removing the rear takedown pin 122. The rear takedown pin 122 is used to secure the shroud 184 to the upper receiver 114. The rear takedown pin 122 is used to secure the hand grip 104 to the lower receiver 116.

Figure 8:
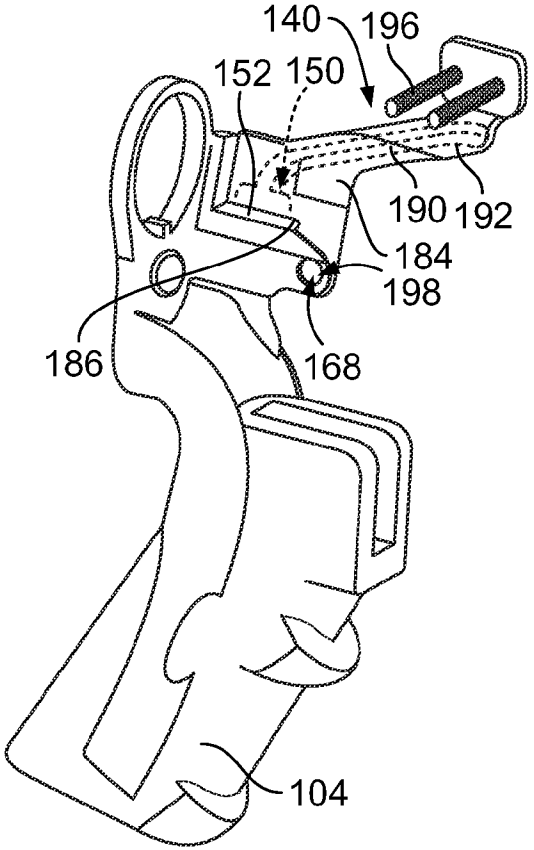
FIG. 8 is a perspective view of the hand grip and the upper connector assembly in a mated position.

FIG. 8 is a perspective view of the hand grip 104 and the shroud 184 in a mated position, with the upper and lower receivers 114, 116 removed for clarity. When mated, the first end 186 of the shroud 184 is seated on the upper surface 152 of the hand grip 104. The lower connector 150 (shown in FIGS. 3 and 4) is received in the upper connector 180 (shown in FIGS. 5 and 6). The takedown pin opening 198 of the shroud 184 is aligned with the takedown pin opening 168 of the hand grip 104.

In an exemplary embodiment, the communication conductors 190 are exposed along an interface of the shroud 184 at the rail interface 192. In the illustrated embodiment, the communication conductors 190 include spring contacts or other types of contacts or communication means at the rail interface 192 for interfacing with contact pads or other types of contacts or communication means on the rail 102 (shown in FIGS. 1 and 2). The upper connector assembly 140 is communicatively connected to the electronics 103 (shown in FIGS. 1 and 2) via the interface between the communication conductors 190 and the contact pads on the rail 102. Other types of interfaces may be used in alternative embodiments to communicatively connect the upper connector assembly 140 with the electronics 103. Other connection means may be used in alternative embodiments, including a hardwired connection across the rail interface 192.

Figure 9:
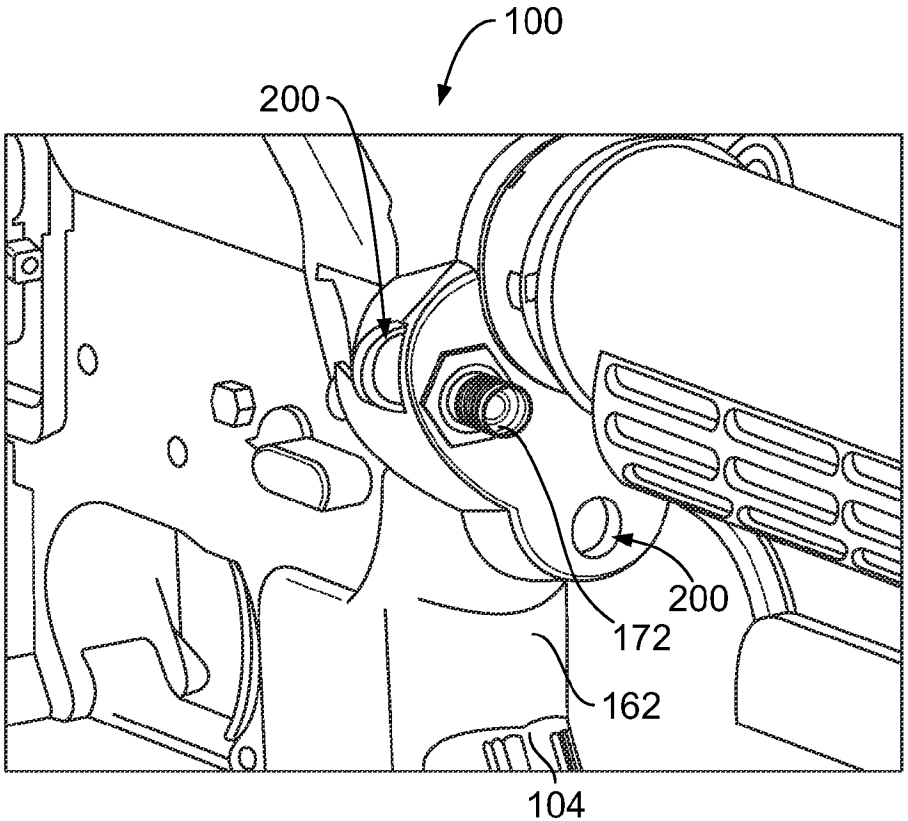
FIG. 9 is a rear perspective view of a portion of the weapon shown in FIG. 1.

FIG. 9 is a rear perspective view of a portion of the weapon 100. The rear 162 of the hand grip 104 is illustrated. The hand grip 104 may include sling loops or mounts 200 for attaching a sling to the weapon 100. The loop 200 may be arranged at one or more locations along the outer surface of the hand grip 104. Any number of loops 200 may be provided at any location along the hand grip 104. FIG. 9 also illustrates the tether connector 172 extending rearward from the hand grip 104. The tether connector 172 may be located at other locations along the hand grip 104 in alternative embodiments.

It is to be understood that the above description is intended to be illustrative, and not restrictive. For example, the above-described embodiments (and/or aspects thereof) may be used in combination with each other. In addition, many modifications may be made to adapt a particular situation or material to the teachings of the invention without departing from its scope. Dimensions, types of materials, orientations of the various components, and the number and positions of the various components described herein are intended to define parameters of certain embodiments, and are by no means limiting and are merely exemplary embodiments. Many other embodiments and modifications within the spirit and scope of the claims will be apparent to those of skill in the art upon reviewing the above description. The scope of the invention should, therefore, be determined with reference to the appended claims, along with the full scope of equivalents to which such claims are entitled. In the appended claims, the terms "including" and "in which" are used as the plain-English equivalents of the respective terms "comprising" and "wherein." Moreover, in the following claims, the terms "first," "second," and "third," etc. are used merely as labels, and are not intended to impose numerical requirements on their objects. Further, the limitations of the following claims are not written in means—plus-function format and are not intended to be interpreted based on 35 U.S.C. §112, sixth paragraph, unless and until such claim limitations expressly use the phrase "means for" followed by a statement of function void of further structure.

What is claimed is:

1. A communication connector system for a weapon, the weapon having an upper receiver at an upper part of the weapon with electronics associated with the upper receiver, the weapon having a base at a lower part of the weapon, the base having a lower receiver and a hand grip, the base housing electronics, the upper receiver being rotatably coupled to the lower receiver and movable between a closed position and an open position, the communication connector system comprising:

an upper connector assembly configured to be coupled to the upper receiver, the upper connector assembly having an upper connector being configured to be communicatively connected to the electronics in the upper receiver, the upper connector having a mating interface; and a lower connector assembly having a lower connector being configured to be communicatively connected to the electronics in the base of the weapon, the lower connector being configured to be mounted to the base of the weapon, the lower connector having a mating interface mated with the mating interface of the upper connector when the upper receiver is in the closed position;

wherein the mating interfaces are physically separable from one another so the upper receiver is configured to be moved to the open position from the closed position.

2. The communication connector system of claim 1, wherein the mating interface of the upper connector and the mating interface of the lower connector engage one another at the interface between the hand grip and the upper receiver to create a communication path between the electronics in the base of the weapon and the electronics in the upper receiver.

3. The communication connector system of claim 1, wherein the upper connector assembly is configured to be fixedly coupled to an outer surface of the upper receiver and being movable with the upper receiver, the upper connector being automatically mated with the lower connector as the upper receiver is moved form the open position to the closed position.

4. The communication connector system of claim 1, wherein the lower connector is configured to be mounted to an upper surface of the hand grip such that the mating interface of the lower connector is generally upward facing, the upper connector being lowered into engagement with the lower connector as the upper receiver is moved from the open position to the closed position.

5. The communication connector system of claim 1, wherein the upper connector assembly includes a shroud configured to be mounted to the upper receiver, the upper connector being accessible at a first end of the shroud, the upper connector assembly including at least one communication conductor extending from the upper connector within the upper shroud to a second end of the shroud, the communication conductor being configured to be communicatively connected to the electronics of the upper receiver.

6. The communication connector system of claim 1, wherein the upper connector assembly includes a shroud configured to be mounted to the upper receiver, the upper connector extending from the shroud, the shroud having a takedown pin opening therethrough, the takedown pin opening being configured to receive a takedown pin used to secure the upper receiver to the lower receiver in the closed position.

7. A communication connector system for a weapon, the weapon having an upper receiver at an upper part of the weapon with electronics associated with the upper receiver, the weapon having a base at a lower part of the weapon, the base having a lower receiver and a hand grip, the base housing electronics, the upper receiver being rotatably coupled to the lower receiver and movable between a closed position and an open position, the communication connector system comprising:

an upper connector assembly configured to be coupled to the upper receiver, the upper connector assembly having an upper connector being configured to be communicatively connected to the electronics in the upper receiver, the upper connector having a mating interface; and a lower connector assembly having a lower connector and a tether connector both being configured to be communicatively connected to the electronics in the base of the weapon, the lower connector and the tether connector both being configured to be mounted to the base of the weapon, the lower connector having a mating interface configured to be mated with the mating interface of the upper connector when the upper receiver is in the closed position, the mating interfaces being physically separable from one another so the upper receiver is configured to be moved to the open position form the closed position, the tether connector being externally accessible external to the weapon and configured for connection with an external connector.

8. The communication connector system of claim 7, wherein the mating interface of the upper connector and the mating interface of the lower connector engage one another at the interface between the base of the weapon and the upper receiver to create a communication path between the electronics in the base of the weapon and the electronics in the upper receiver.

9. The communication connector system of claim 7, wherein the upper connector assembly includes a shroud configured to be mounted to the upper receiver, the upper connector being accessible at a first end of the shroud, the upper connector assembly including at least one communication conductor extending from the upper connector within the upper shroud to a second end of the shroud, the communication conductor being configured to be communicatively connected to the electronics of the upper receiver.

10. The communication connector system of claim 7, wherein the upper connector assembly includes a shroud configured to be mounted to the upper receiver, the upper connector extending from the shroud, the shroud having a takedown pin opening therethrough, the takedown pin opening being configured to receive a takedown pin used to secure the upper receiver to the lower receiver in the closed position.

11. A weapon comprising:

a lower part having a lower receiver having a forward attachment point and a rearward attachment point, the lower part having a hand grip extending from the lower receiver proximate to the rearward attachment point, the base of the weapon housing electronics therein;

an upper part having an upper receiver removably attachable to the lower receiver at the forward attachment point and the rearward attachment point, the upper receiver having a forward attachment point and a rearward attachment point, the upper receiver having electronics;

front and rear takedown pins connecting the upper and lower receivers at the forward and rearward attachment points, respectively, wherein the upper receiver is rotatably coupled to the lower receiver at the forward attachment points when the rear takedown pin is removed from the rearward attachment points, the upper receiver being rotatable about the front takedown pin between an open position and a closed position, the rear attachment points being aligned and configured to receive the rear takedown pin in the closed position, the rear attachment points being positioned apart from one another in the open position; and a communication connector system communicatively connecting the electronics of the base of the weapon with the electronics of the upper receiver, the communication connector system including:

an upper connector assembly coupled to the upper receiver, the upper connector assembly having an upper connector being communicatively connected to the electronics in the upper receiver, the upper connector having a mating interface; and a lower connector assembly having a lower connector being communicatively connected to the electronics in the base of the weapon, the lower connector being mounted to the hand grip, the lower connector having a mating interface being configured to be mated with the mating interface of the upper connector when the upper receiver is in the closed position, the mating interfaces being physically separable from one another so the upper receiver is able to be rotated to the open position.

12. The weapon of claim 11, wherein the lower connector assembly includes a tether connector communicatively connected to the electronics in the base of the weapon, the tether connector being mounted to the hand grip, the tether connector being externally accessible exterior of the hand grip and being configured for connection to an external connector.

13. The weapon of claim 11, wherein the lower receiver includes a rearward extending buffer tube, the hand grip includes a buffer tube opening, the buffer tube extending through the buffer tube opening.

14. The weapon of claim 11, wherein the lower receiver includes a takedown pin opening at the rearward attachment point thereof, the hand grip includes a takedown pin opening, the upper receiver includes a takedown pin opening at the rearward attachment point thereof, the upper connector includes a takedown pin opening, the takedown pin openings of the lower receiver, the hand grip, the upper receiver and the upper connector being aligned with one another when the upper receiver is in the closed position to receive the rear takedown pin.

15. The weapon of claim 11, wherein the hand grip includes an upper surface and opposite sides, the lower connector provided on the upper surface between the sides.

16. The weapon of claim 11, wherein the mating interface of the upper connector and the mating interface of the lower connector engage one another at the interface between the hand grip and the upper receiver to create a communication path between the electronics in the base of the weapons and the electronics in the upper receiver.

17. The weapon of claim 11, wherein the upper connector assembly is fixedly coupled to an outer surface of the upper receiver and is movable with the upper receiver, the upper connector being automatically mated with the lower connector as the upper receiver is moved form the open position to the closed position.

18. The weapon of claim 11, wherein the lower connector is fixedly mounted to an upper surface of the hand grip such that the mating interface of the lower connector is generally upward facing, the upper connector being fixedly mounted to the upper receiver, the upper connector being movable with the upper receiver thereby automatically mating the upper connector and the lower connector as the upper receiver is moved from the open position to the closed position.

19. The weapon of claim 11, wherein the upper connector assembly includes a shroud configured to be mounted to the upper receiver, the upper connector being accessible at a first end of the shroud, the upper connector assembly including at least one communication conductor extending from the upper connector within the upper shroud to a second end of the shroud, the communication conductor being communicatively connected to the electronics of the upper receiver.

20. The weapon of claim 11, wherein the upper connector assembly includes a shroud configured to be mounted to the upper receiver, the upper connector extending from the shroud, the shroud having a takedown pin opening therethrough, the takedown pin opening receiving the rear takedown pin used to secure the upper receiver to the lower receiver in the closed position.

* * * * *